US005846008A

United States Patent [19]

Park

[11] Patent Number: 5,846,008

[45] Date of Patent: Dec. 8, 1998

[54] SHEET ALIGNMENT DEVICE FOR USE IN A PRINTING APPARATUS

[75] Inventor: Jin-ho Park, Kyungki-do, Rep. of Korea

[73] Assignee: Samsung Electronics Co., Ltd., Suwon, Rep. of Korea

[21] Appl. No.: 756,309

[22] Filed: Nov. 25, 1996

[30] Foreign Application Priority Data

Nov. 24, 1995 [KR] Rep. of Korea ..... 95-35418

[51] Int. Cl.[6] ..... B41J 13/02

[52] U.S. Cl. ..... 400/634; 400/636

[58] Field of Search ..... 400/634, 636, 400/645

[56] References Cited

U.S. PATENT DOCUMENTS

| | | | |
|---|---|---|---|
| 4,509,734 | 4/1985 | Rutishauser | 271/10 |
| 4,522,385 | 6/1985 | Stefansson | 271/10 |
| 4,529,188 | 7/1985 | Sturnick | 271/10 |
| 4,589,646 | 5/1986 | Ozawa et al. | 271/4 |
| 5,116,038 | 5/1992 | Kim | 271/10 |
| 5,624,109 | 4/1997 | Tanaka | 271/10.13 |

*Primary Examiner*—Edgar S. Burr
*Assistant Examiner*—Anthony H. Nguyen
*Attorney, Agent, or Firm*—Banner & Witcoff, Ltd.

[57] ABSTRACT

A sheet alignment device for lining up a sheet being fed to a proper location for printing operation is disclosed. A driving gear is fittingly inserted and mounted on an axial end portion of a pivot on which at least a pair of feeding rollers are integrally formed. A torsion coil knock-up spring is used to link the pivot and the driving gear. When operated, the torsion coil knock-up spring reserves and accumulates torsion moment of the pivot. Upon cease of rotational motion of driving gear, the accumulates torsion moment forces the pivot to continue rotation thereof, allowing a sheet to advance more thereby securing printing operation from failure.

4 Claims, 2 Drawing Sheets

SHEET ALIGNMENT DEVICE FOR USE IN A PRINTING APPARATUS

BACKGROUND OF THE INVENTION

The present invention relates to a device for aligning sheets, and more particularly, to an aligning device for lining up sheets that are fed by turns to a printing apparatus such as an ink jet printer, which is capable of disposing an edge portion of a sheet at a proper location for a printing operation regardless of the properties of a sheet such as thickness and elasticity.

Contemporary sheet feeding system as is well known in the art of printing apparatus such as a printer or a plain paper facsimile machine typically includes a paper tray, as shown in FIG. 1. In the above mentioned system, a pick-up roller 11 is installed at substantially front portion of paper tray 10. A knock-up plate 30 mounted in a tray 10 is forced to push up a bunch of papers in the direction of the longitudinal axis of pick-up roller 11 by knock-up spring force thereby securing close adhesion of the top place sheet to pick-up roller 11. A guide 40 disposed to guide a sheet is installed adjacent the edge portion of front end of tray 10. Both rollers for delivering and securing papers, main roller 15 and friction roller 17, are provided at the middle path for delivering a sheet being guided by guider 40 in the forward direction.

In operation of sheet feeding apparatus of such above construction, the top place sheet mounted in a tray 10 is fed to the sensing point adjacent a contact gap between friction roller 17 and main roller 15 by virtue of frictional force with the surface of pick-up roller 11 when the roller becomes to rotate. Thereafter main roller 15 is driven so as to deliver a sheet being fed from tray 10 to a proper location for printing. On this occasion, a sheet picked-up from tray 10 is to be delivered and advanced in the direction of level crossing with respect to a carriage (print head) movement.

To secure alignment of sheets being delivered for proper printing operation conventional practice employees such a configuration as illustrated in FIG. 2. In the above configuration, main roller 15 is provided at a location parallel with the path of a carriage movement plane . A friction roller 17 is disposed to almost contact with the top surface of main roller 15. Then a delivery time is measured during which a sheet can be delivered in good distance longer than the distance between pick-up roller 11 and main roller 15 when pick-up roller 11 initiates feeding operation so that main roller 15 can be rotated in the reverse direction with respect to sheet feeding direction during the given time interval.

As a result main roller 15 that rotates in an opposite direction to sheet feeding operation hinders sheet from moving forward direction though the edge portion of the sheet is still being forced to advance by pick-up roller 11. Thus a sheet of which edge portion being kept to contact with the sensing point adjacent a gap between main roller 15 and friction roller 17, is bent round by a curve as much distance as transferable by rotational motion of pick-up roller 11 thereby causing the sheet to have an elasticity. As previously noted, the edge portion of a sheet is forced to securely contact with surfaces of both friction roller 17 and main roller 15, resulting in alignment with the direction of carriage movement.

Conventionally constructed sheet feeding apparatus as described in the above paragraphs, however, possess drawbacks. Among the drawbacks, it was a problem when such papers as an OHP film or even a plain paper with substantial thickness, both being stiffer and having resistance to bending were fed. On such occasions, those stiffer sheets are unable to bend and advance for sheet alignment upon shift of rotational motion of main roller 15, resulting in a loss of the movement through the curve due to slippage of the sheet relative to the pick-up roller, thereby causing a failure to bridge the gap between friction roller 17 and main roller 15 and contact both rollers.

Further, a back lash phenomenon produced mechanically at the instant of shifting of power transmission generated by main roller 15, hinders such sheets as described above from retaining a bend as much distance as equal to that produced by the above back lash. These factors as described among others prevent above mentioned sheets from retaining a minimum transfixing force (F) required for proper feeding operation, causing a failure or sheet feeding error.

Based upon observations on most contemporary sheet feeding apparatus, it is found that in case of main roller being made of relatively high coefficient of friction such as rubber material , a sheet being fed is prone to excessively bend such that the edge portion thereof being eventually caught at some portion of circumference during rotation of main roller 15 in reverse direction thereby causing sheet feeding error.

SUMMARY OF THE INVENTION

Therefore, it is an object of the present invention to provide a sheet alignment device by which the front edge portion of a sheet being fed from pick-up roller is secured to retain a tight contact with a sensing point adjacent a gap formed between friction roller and main roller, thereby preventing sheet feeding errors.

It is another object of the present invention to provide a sheet alignment device capable of delivering a sheet in the forward direction at a predetermined distance by an additional rotating force produced by a pick-up roller subsequent to the stopping of the rotating motion of a driving gear for driving the pick-up roller.

It is yet another object of the present invention to support a transfixing force at the front edge portion of a sheet being fed thereby preventing a failure from sheet feeding operation regardless of the properties of papers retained in a tray. It is still another object of the present invention to secure a timely delivery of a sheet being fed to a proper location for a printing operation thereby enhancing product efficiency.

To achieve these and other objects, a sheet alignment device for use in a sheet feeding apparatus in which a driving gear is provided at an end portion of a pivot on which a pick-up roller is integrally formed. A knock-up spring coupler is used to link the driving gear and the pivot which spring coupler is disposed to reserve the turning effect of the above driving gear. Upon ceasing of the rotational motion of a driving gear, a reserved turning effect on a torsion coil of spring coupler causes a pivot to keep rotation, applying advancing force to a sheet being fed, thereby securing the sheet to locate at a proper position for printing operation.

BRIEF DESCRIPTION OF THE DRAWINGS

A more complete appreciation of the invention, and many of the attendant advantages thereof better understood by reference to the following detailed description when considered in conjunction with the accompanying drawings in which like reference symbols indicated the same or similar components, wherein.

DETAILED DESCRIPTION OF THE EMBODIMENT

Figure 3:
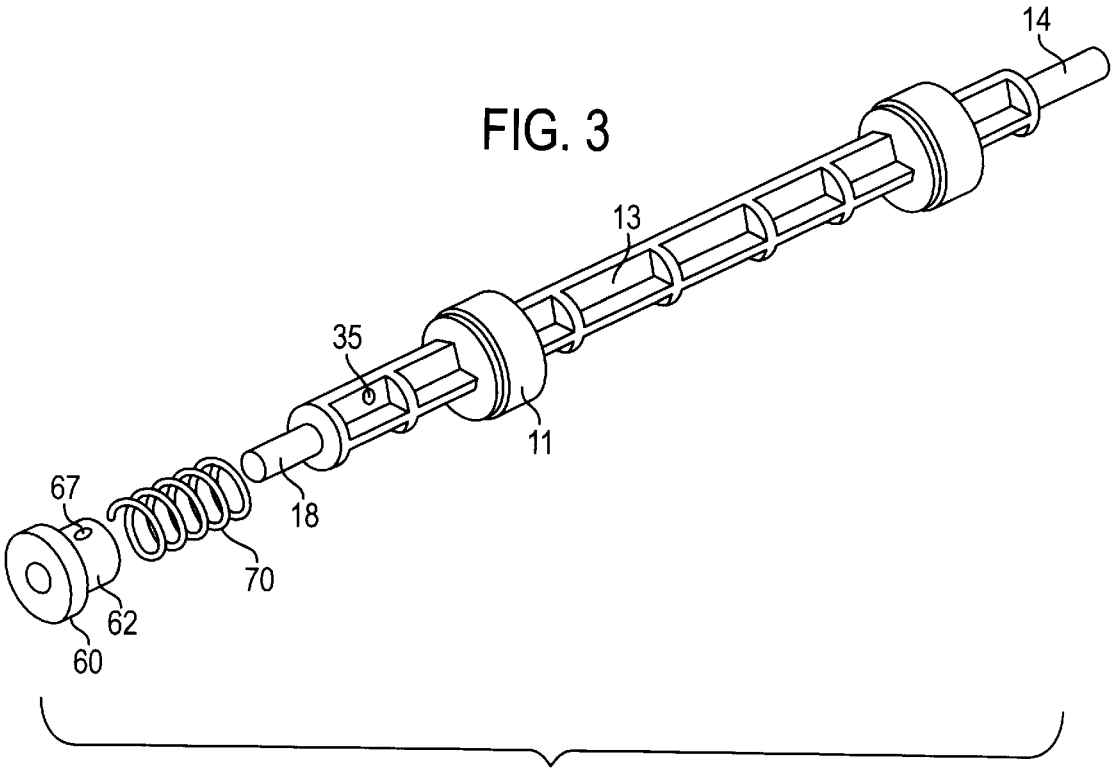
FIG. 3 is a perspective view of a sheet alignment device for use in a sheet feeding apparatus according to the principles of the present invention.

Turning now to the drawings , a perspective view of sheet alignment device according to an embodiment of the present invention is illustrated in FIG. 3. The exemplar illustration in FIG. 3 includes at least two pick-up roller 11 spaced apart disposed on a pivot 13, for feeding sheets 50 to a proper location for printing in a printing apparatus . Driving gear 60 provided and installed at one portion of pivot 13 is disposed to be engaged with an end portion of a pivot 13 by spring coupler 70. Knock-up spring coupler 70 is disposed to be installed in such a manner that the knock-up spring being wound during rotational movement of driving gear 60.

At least a pair of feeding rollers 11 are space apartedly provided at predetermined locations on the pivot 13. One end portion 14 of pivot 13 is substantially cylindrical shaped so as to mount a bracket thereon while another end portion 18 is of shaft shape so as to be inserted into driving gear 60. A guide portion 62 is integrally formed on a surface of driving gear 60. Both end arms of spring coupler 70 is disposed to be inserted respective first hole 35 provided at a predetermined location on pivot 13 and second hole 67 formed on guide portion 62, such that firm engagement is secured between driving gear 60 and pivot 13. The spring coupler 70 is employed to transmit power from a power source (not shown) to the pivot 13, and store and release rotational momentum to cause pivot 13 to continue to rotate after driving gear 60 stops rotating.

Once driving gear 60 initiates to rotate by a turning effect transmitted from a power source (not shown), spring coupler 70 of which arm get caught in second hole 67 is forced to wind with respect to pivot 13. As driving gear 60 keeps rotational motion and turns on the pivot 13, spring coupler 70 retains more torsion moment to its maximum tolerance. Upon occasion of retention of maximum torsion moment by continued rotation, spring coupler then forces pivot 13 to turn.

Therefore, feeding rollers 11 provided at predetermined position on pivot 13 become to turn and in turn to push away a sheet in contact with the lowest surface by using friction force. As noted previously, the sheet being forced is sufficiently pulled to move forward to reach a peripheral surface of main roller 15.

On the occasion of stop of rotational motion of driving gear 60, torsion moment retained in spring coupler 70 still keeps pivot 13 to turn in same direction which in turn forces pick-up roller to maintain rotational movement. As a result, pick-up roller 11 is urged to re-rotate, feeding a sheet, aligning the front edge portion of the sheet in the vicinity of the contact point between friction roller and main roller, otherwise a failure may occurred due to a slip or backlash at the moment of driving gear stop.

Figure 1:
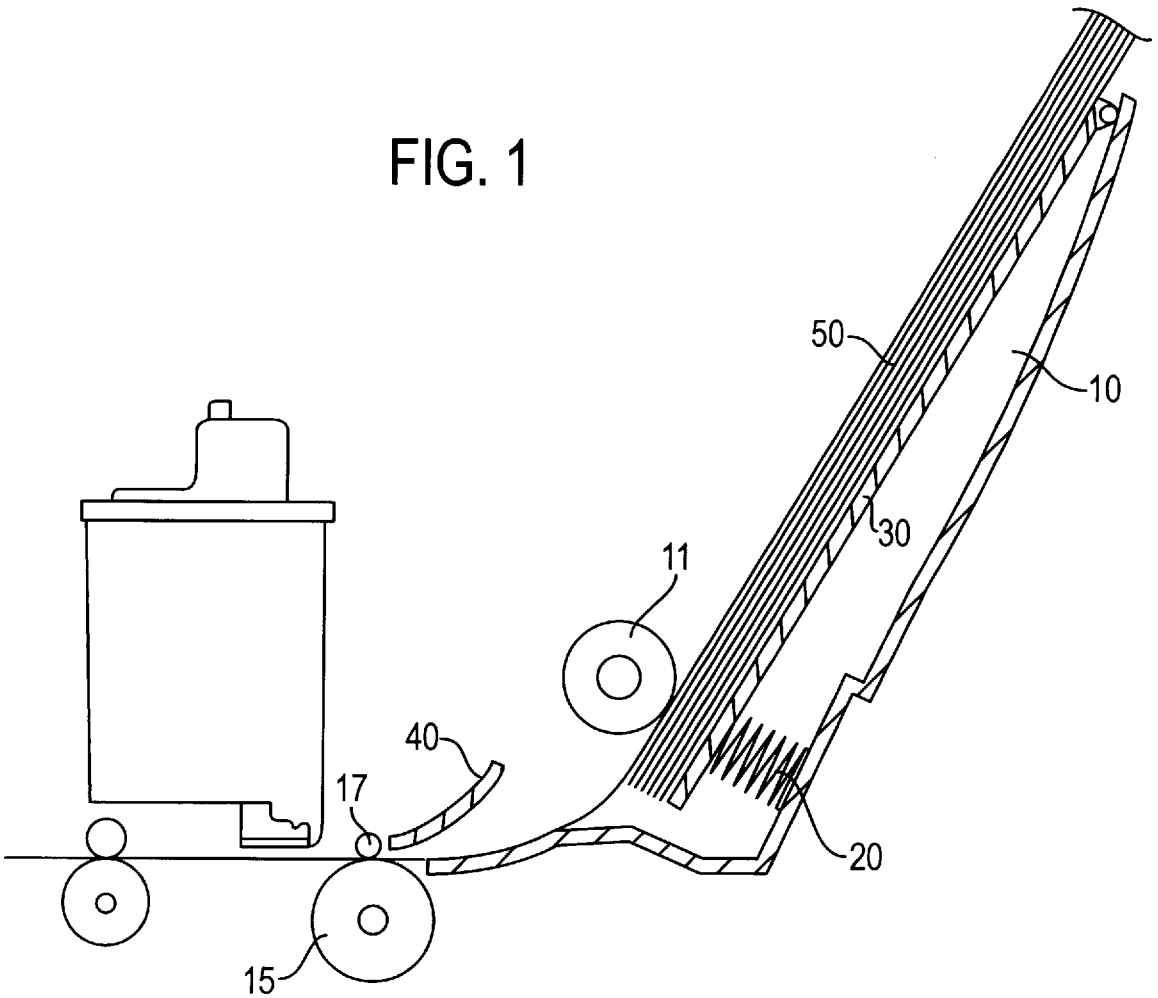
FIG. 1 is a schematic elevational diagram of a sheet feeding apparatus conventionally adopted in the art of auto sheet feeding practice.
Figure 2:
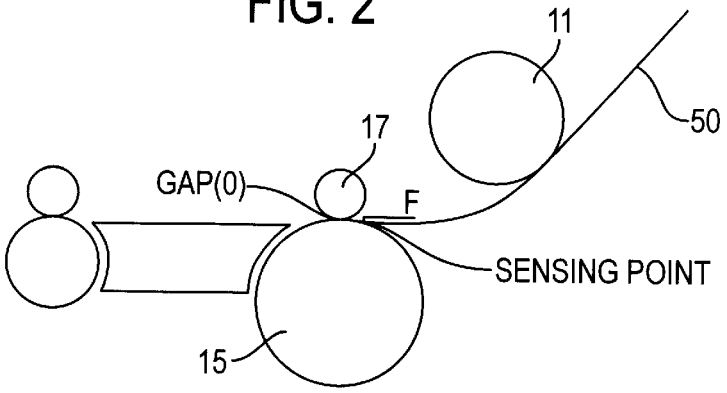
FIG. 2 is a schematic diagram of a sheet feeding mechanism used in conventional printing apparatus.

When enough time has elapsed during which the end portion of a sheet being fed is delivered to contact a gap (O) formed between the friction roller 17 and main roller 15, the driving gear 60 ceases rotational motion for an alignment of the sheet while the main roller 15 starts rotational movement in the reverse direction (i.e., clockwise in FIG. 2).

Accordingly, the driving gear 60 ceases rotational movement for sheet alignment while the spring coupler 70 starts to unwind its coil so as to release the torsional moment retained thereon. This torsional moment forces the pivot 13 to keep rotating even after driving gear 60 has stopped.

Thus, the pick-up roller is forced to maintain rotation allowing a sheet to move forward a predetermined distance, thereby securing tight contact between the end portion of a sheet and the gap (O). Therefore, a backlash phenomenon which occurs upon a stoppage of the driving gear 60 or a slippage phenomenon caused by the pick-up roller 11 no longer hinders sheet alignment.

Therefore, torsional moment as explained above can sufficiently offset any forces caused by backlash phenomenon and may still reinforce transfix force (F) at a substantially constant level thereby securing printing operational efficiency. Such a torsional torque as described above may be enough if the strength thereof applied to a sheet being fed gives at least a minimum transfix force (F) required for proper sheet feeding operation However, the strength of above described a torsional torque is to be less than such a torque that may cause a frictional slip between a sheet and pick-up roller. That is, at the initial stage of pick-up and feed operation or otherwise during reverse rotation motion of main roller 15 for sheet alignment, torsion coil spring is required to reserve a sufficient quantity of torsional moment in advance to an occurrence of a slip as explain above.

As described above, according to sheet alignment configuration of one preferred embodiment of the present invention, a sheet being fed is secured to reach in the vicinity of main roller regardless of any properties of paper in a tray, preventing failure from sheet feeding operation thereby enhancing product efficiency.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A sheet alignment device for use in a sheet feeding apparatus to feed a sheet to a pick-up location and maintain an edge of the sheet at the pick-up location, said device comprises:

a pivot having a pick-up roller integrally formed thereon;

a driving gear disposed at one end portion of said pivot for transmitting power to directly control rotation of said pivot and said pick-up roller in a first direction to thereby feed the sheet to the location; and a spring coupler coupling said pivot and said driving gear together such that rotation of said driving gear winds said spring coupler to store rotational energy which in turn rotates said pivot in said first direction after said driving gear has stopped to thereby maintain an edge of the sheet in the pick-up location.

2. The sheet alignment device according to claim 1, in which said spring coupler is disposed to wind in the rotating direction of said pick-up roller.

3. The sheet alignment device according to claim 1, in which at least a pair of said feeding rollers are spaced apart and provided integrally on said pivot.

4. A sheet alignment device for use in a sheet feeding apparatus, said device comprising:

a pick-up roller fixedly mounted on a shaft for feeding a sheet into a predetermined pick-up location;

a driver disposed at one end of said shaft for directly driving said shaft in a first rotational direction;

a spring coupler attached to said shaft and said driver such that rotation of said driver in said first direction winds said spring coupler to store rotational momentum which in turn forces said shaft and said pick-up roller to rotate in said first direction after said driver ceases rotating to continually bias and align the sheet into said pick-up location; and a main roller disposed at said pick-up location to rotate in a second rotational direction to feed the sheet through said apparatus.

* * * * *